US005255461A

United States Patent [19]

Chiou

[11] Patent Number: 5,255,461

[45] Date of Patent: Oct. 26, 1993

[54] SOUND PRODUCING DECORATIVE ARTICLE

[76] Inventor: Long-Fu Chiou, 3F, No. 15, Lane 47, Nan-Hsiao St., Changhua Hsien, Taiwan

[21] Appl. No.: 967,168

[22] Filed: Oct. 27, 1992

[51] Int. Cl.[5] ..... G09F 19/08

[52] U.S. Cl. ..... 40/415; 40/411; 84/94.2; 472/6

[58] Field of Search ..... 40/411, 414, 415, 423; 84/94.2, 95.2; 446/280, 297, 303, 358; 472/6, 7

[56] References Cited

U.S. PATENT DOCUMENTS

| | | | |
|---|---|---|---|
| 2,559,201 | 7/1951 | Schy et al. | 446/358 X |
| 2,585,467 | 2/1952 | Huth | 446/358 X |
| 4,344,243 | 8/1982 | Reszka | 40/414 X |
| 4,890,828 | 1/1990 | Hou | 472/6 |

*Primary Examiner*—Kenneth J. Dorner
*Assistant Examiner*—Brian K. Green
*Attorney, Agent, or Firm*—Ladas & Parry

[57] ABSTRACT

A sound producing decorative article includes a housing having a top, a bottom, and a cavity formed in the housing. The top has a first opening, and the bottom has a second opening. Both of the openings are communicated with the cavity. A tubular supporting member passes through the first opening and is mounted detachably on the top. A guiding unit includes a mounting member provided in the cavity and a guiding rod extending from the mounting member. A toy supporting unit includes a post having a top end on which a toy is mounted, and an engaging member fixed to a bottom end of the post and having a notch. The post extends through the tubular supporting member via the cavity and the notch engages slidably the guiding rod. A moving unit for moving the toy supporting unit includes a base, an eccentric wheel mounted rotatably on the base, and a driving unit for actuating rotatably the eccentric wheel. The eccentric wheel has a periphery which supports the engaging member, while the eccentric wheel and the driving unit are received in the cavity when the base is mounted on the bottom in order to close the second opening.

5 Claims, 6 Drawing Sheets

SOUND PRODUCING DECORATIVE ARTICLE

BACKGROUND OF THE INVENTION

1. Field of the Invention

This invention relates to a sound producing decorative article, more particularly to an improved sound producing decorative article which can be easily detached and which has a long service time.

2. Description of the Related Art

Referring to FIGS. 1 and 2, a conventional sound producing decorative article (C1) includes a housing (20) which has a top, a bottom and a surrounding wall which interconnects the top and the bottom. A pair of parallel guiding rods (23, 24) are fixed in the housing (20) and extend from the top to the bottom of the housing (20). A pair of compression springs (25, 26) are sleeved around the guiding rods (23, 24), respectively. A movable member (22) is slidably sleeved on the guiding rods (23, 24) and rests on the compression springs (25, 26). The movable member (22) has a slot (221) and a recess (222) formed thereon. A toy supporting post (27) has a top end on which a decorative toy (10) is to be mounted and a bottom end which passes through the top of the housing (20) and which is fixed in the recess (222) of the movable member (22). A moving means (M1) is mounted in the housing (20) for moving reciprocatingly the movable member (22) upward and downward so as to move the decorative toy (10) upward and downward. The moving means (M1) includes a driving mechanism (D1) which has an output shaft (S1), a knob (K1) and a driving spring (not shown) which is operable via the knob (K1) and which is connected to the output shaft (S1), a sound generating unit (G1) connected to the output shaft (S1), and a rotatable eccentric wheel (21) mounted on the output shaft (S1). The eccentric wheel (21) has a lug (211) projecting therefrom and engaging the slot (221) of the movable member (22). The eccentric wheel (21) is actuated rotatably while the sound generating unit (G1) is actuated to produce sound simultaneously when the knob (K1) is turned in order to operate the driving spring so as to drive the output shaft (S1) to rotate. The movable member (22) is thereby caused to move reciprocatingly upward and downward. Therefore, the decorative toy (10) also moves reciprocatingly upward and downward.

Generally, the conventional sound producing decorative article (C1) is assembled by the manufacturer and cannot be detached by the consumer. Since the conventional sound producing decorative article (C1) is not detachable, it occupies a relative large space when packed. Therefore, it is inconvenient to store and transport the decorative article (C1). In addition, since the conventional sound producing decorative article (C1) is not assembled by the consumer, it cannot provide assembling amusement to the consumer. Furthermore, the compression springs (25, 26) bear the decorative toy (10), the supporting post (27) and the movable member (22) thereon. The elastic resilience of the compression springs (25, 26) easily fails over a period of time, thereby causing inoperation of the conventional sound producing decorative article (C1). Thus, the conventional sound producing decorative article (C1) has a relative short service life.

SUMMARY OF THE INVENTION

Therefore, the objective of the present invention is to provide an improved sound producing decorative article. The improved sound producing decorative article can be easily detached when packed so that it occupies a relatively small space to facilitate storage and transport. The improved sound producing decorative article can be easily assembled by the consumer so that it can provide assembling amusement to the consumer. In addition, the improved sound producing decorative article has a long service life.

Accordingly, the sound producing decorative article of the present invention includes a decorative toy and a housing which has a top, a bottom, a surrounding wall connected to the top and the bottom, and a cavity cooperatively formed thereby. The top has a first opening communicated with the cavity, while the bottom has a second opening communicated with the cavity.

A tubular supporting member has a top portion, a bottom portion, an intermediate portion interconnecting the top and bottom portions, and a collar extending radially from the intermediate portion. The collar rests detachably on the top of the housing and the bottom portion passes through the first opening of the top of the housing and protrudes into the cavity.

A guiding unit is provided in the cavity of the housing. The guiding unit includes a mounting member sleeved detachably around the bottom portion of the tubular supporting member, and a guiding rod extending downwardly from the mounting member.

A fastening means is used to fasten the tubular supporting member and the mounting member of the guiding unit on the top of the housing.

A toy supporting unit includes an elongated first post that has a top end on which the decorative toy is to be mounted detachably and a bottom end, and an engaging member fixed to the first post adjacent to the bottom end. The engaging member has a notch formed thereon. The first post extends slidably through the tubular supporting member via the cavity of the housing, and the notch of the engaging member engages slidably the guiding rod when the toy supporting unit is mounted detachably on the housing.

A moving means, which is used to move the toy supporting unit upward and downward, includes a base, a sound generating unit mounted on the base, an eccentric wheel mounted rotatably on the base, and a driving unit mounted on the base to actuate rotatably the eccentric wheel. The driving unit further actuates the sound generating unit to produce sound. The eccentric wheel has a periphery which supports the engaging member of the toy supporting unit, while the eccentric wheel, the sound generating unit, the driving unit are received in the cavity when the base is detachably mounted on the bottom of the housing in order to close the second opening of the bottom.

BRIEF DESCRIPTION OF THE DRAWINGS

Other features and advantages of the present invention will become apparent in the following detailed description of the preferred embodiments, with reference to the accompanying drawings, in which.

DETAILED DESCRIPTION OF THE PREFERRED EMBODIMENTS

Figure 1:
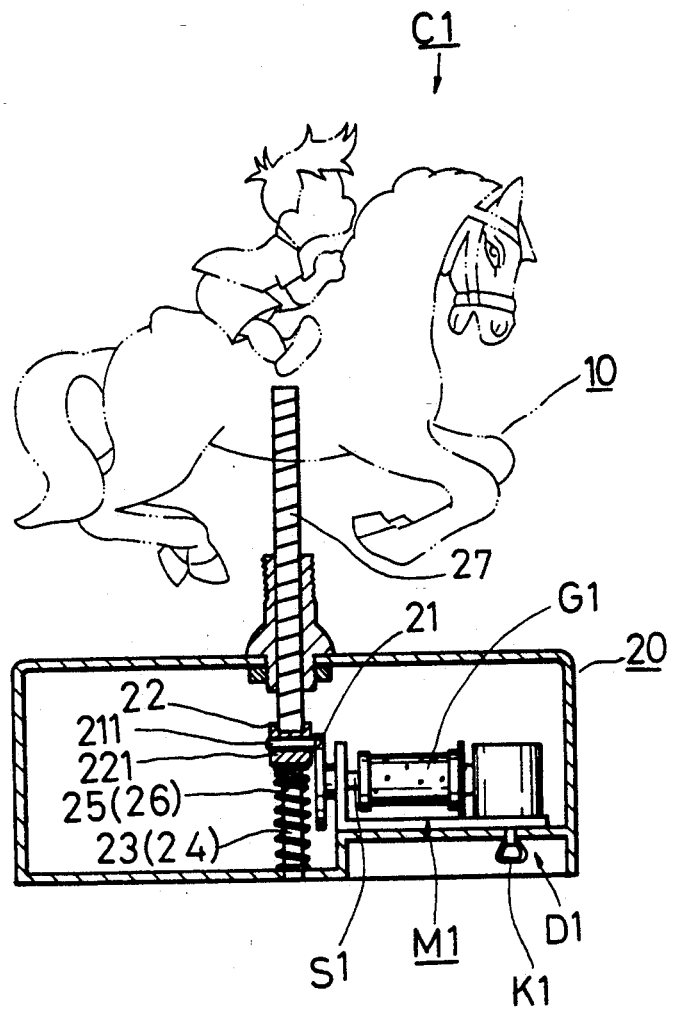
FIG. 1 PRIOR ART
FIG. 1 is a partially sectional view of a conventional sound producing decorative article.
Figure 2:
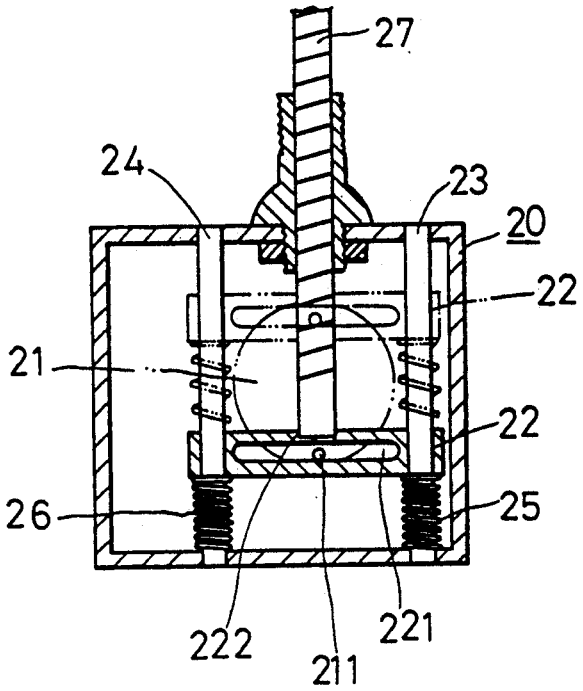
FIG. 2 PRIOR ART
FIG. 2 is another partially sectional view of the conventional sound producing decorative article shown in FIG. 1.
Figure 3:
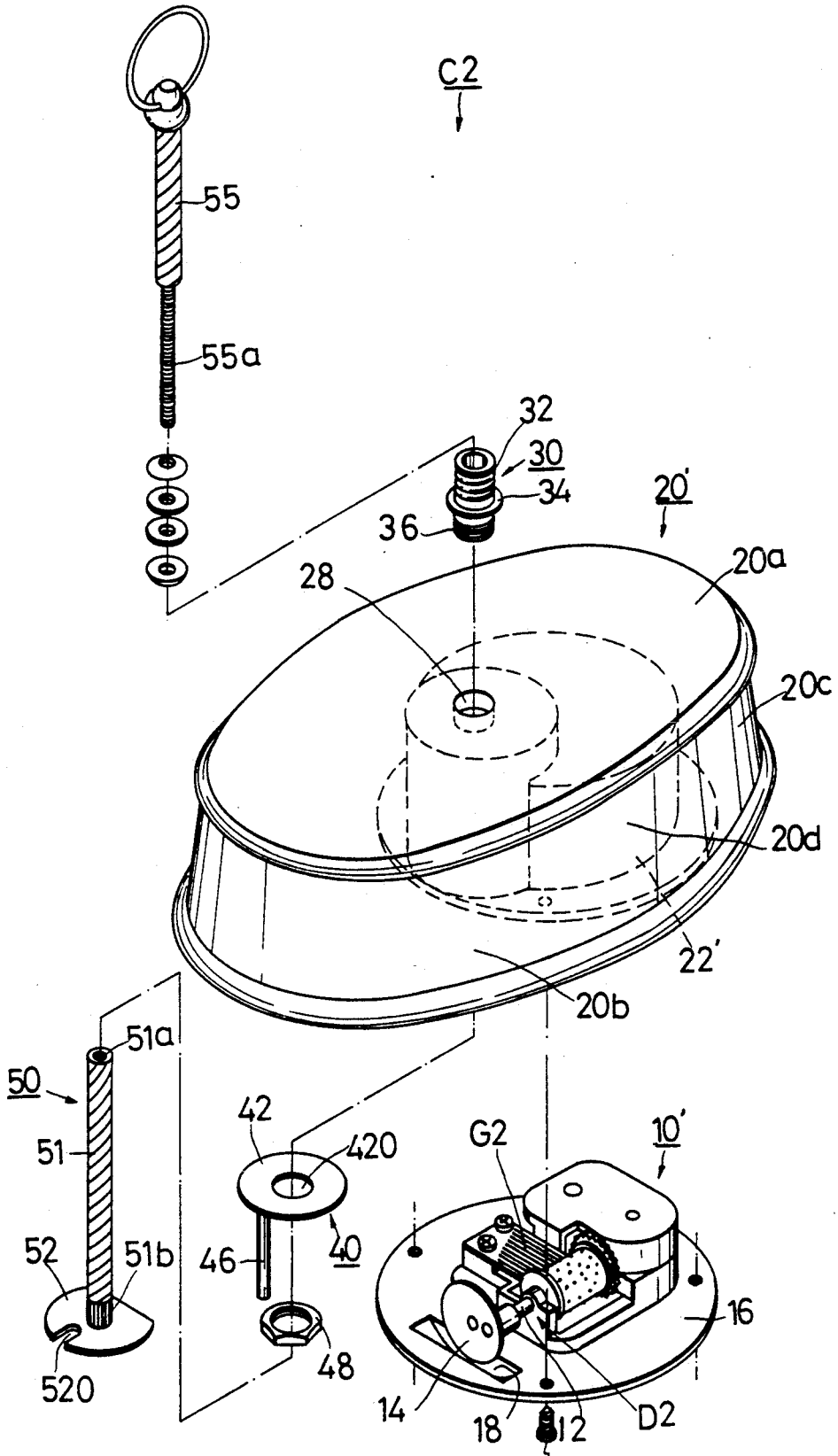
FIG. 3 is an exploded view of a sound producing decorative article of the present invention.
Figure 4:
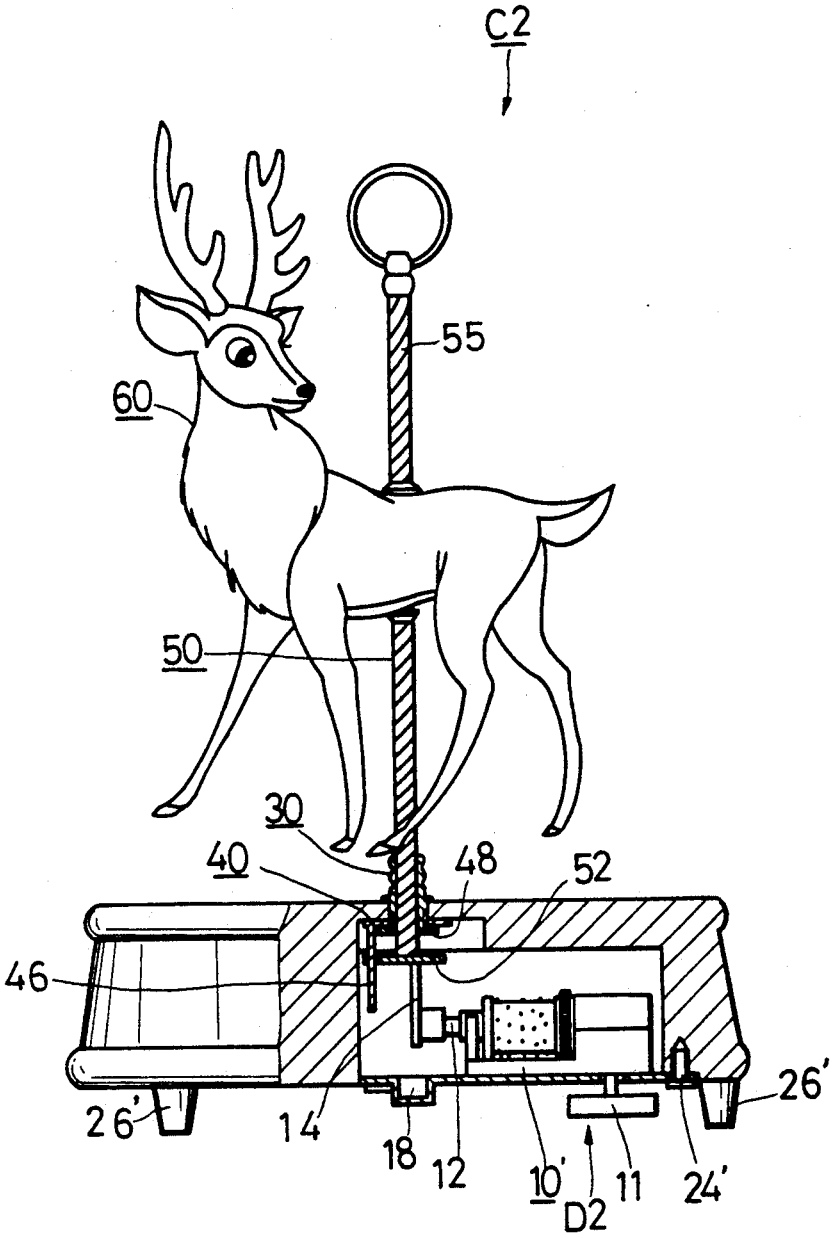
FIG. 4 is a partially sectional view of the assembled sound producing decorative article of the present invention when the decorative toy is moved upward to an upper position.
Figure 5:
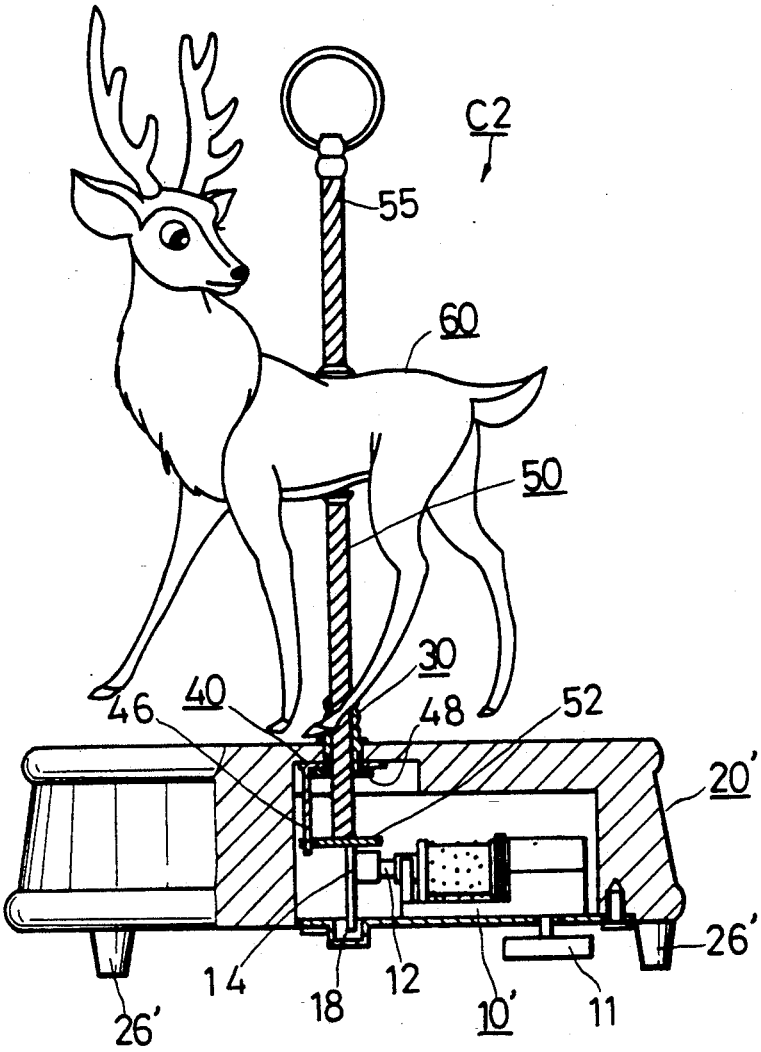
FIG. 5 is a partially sectional view of the assembled sound producing decorative article of the present invention when the decorative toy is moved downward to a lower position.

Referring to FIGS. 3 to 5, a sound producing decorative article (C2) of the present invention includes a decorative toy (60) and a housing (20') which has a top (20*a*), a bottom (20*b*) mounted with legs (26'), a surrounding wall (20*c*) connected to the top (20*a*) and the bottom (20*b*), and a cavity (22') cooperatively formed thereby. The top (20*a*) has a first opening (28) which is communicated with the cavity (22'). The bottom (20*b*) has a second opening (20*d*) communicated with the cavity (22'). A tubular supporting member (30) has a top portion (32), a bottom portion (36), an intermediate portion interconnecting the top and bottom portions (32, 36), and a collar (34) extending radially from the intermediate portion. The bottom portion (36) has exterior threads formed thereon. The collar (34) rests detachably on the top (20*a*) of the housing (20'), and the bottom portion (36) passes through the first opening (28) and protrudes into the cavity (22').

A guiding unit (40) is provided in the cavity (22') and includes a disk (42) having a central hole (420) and a guiding rod (46) extending downwardly from the disk (42). The disk (42) is sleeved around the bottom portion (36) of the tubular supporting member (30). A nut (48) is screwed onto the bottom portion (36) in order to fasten the tubular supporting member (30) and the disk (42) on the housing (20').

A toy supporting unit (50) includes an elongated first post (51) that has a top end (51*a*) which is formed with a threaded bore and a bottom end (51*b*), and a plate member (52) which is fixed to the bottom end (51*b*) and which has a notch (520) formed thereon. The first post (51) extends slidably through the tubular supporting member (30) via the cavity (22'), while the notch (520) of the plate member (52) engages the guiding rod (46). The toy supporting unit (50) further has a second post (55) which has a threaded insert portion (55*a*) that can pass detachably through the decorative toy (60) so as to be screwed onto the top end (51*a*) of the first post (51).

A moving means (10') for moving the toy supporting unit (50) upward and downward includes a base plate (16) which is formed with a recess (18), a driving mechanism (D2) which has an output shaft (12), a knob (11) and a driving spring (not shown) operable via the knob (11) and connected to the output shaft (12), a sound generating unit (G2) connected to the output shaft (12), and a rotatable eccentric wheel (14) mounted on the output shaft (12) and disposed above the recess (18). The eccentric wheel (14) has a periphery which supports the disk (52) of the toy supporting unit (50), while the eccentric wheel (14), the sound generating unit (G2), the driving mechanism (D2) are received in the cavity (22'), except for the knob (11) which protrudes through the base plate (16), when the base plate (16) is detachably mounted on the bottom (20*b*) of the housing (20') by means of screws (24') in order to close the second opening (20*d*) of the bottom (20*b*) The eccentric wheel (14) is actuated rotatably, while the sound generating unit (G2) is actuated to produce sound simultaneously when the knob (11) is turned in order to operate the driving spring so as to drive the output shaft (12) to rotate. Since the plate member (52) of the toy supporting unit (50) rests on the eccentric wheel (14), the toy supporting unit (50) is caused to move reciprocatingly upward and downward. Therefore, the decorative toy (60) moves reciprocatingly upward and downward.

In addition, the housing (20') can be made of wood or plastic. The tubular supporting member (30) can be made of copper. The base plate (16) of the moving means (10') can be made of plastic.

The tubular supporting member (30), the guiding unit (40), the first post (51) with the plate member (52), and the moving means (10') can be mounted onto the housing (20') in this sequence by the consumer. Thereafter, the second post (55) passes through the decorative toy (60) and is screwed onto the first post (51). The sound producing decorative article (C2) can therefore be assembled easily so as to provide assembling amusement to the consumer. Since the sound producing decorative article (C2) of the present invention is detachable, it occupies a relative small space when packed, thereby facilitating its storage and transport. The compression springs, which are provided in the conventional sound producing decorative (C1), are not needed in the present invention. The sound producing decorative article (C2) therefore has a relatively long service life.

FIG. 4 shows the decorative toy (60) when moved upward to an upper position. FIG. 5 shows the decorative toy (60) when moved downward to a lower position in which the eccentric wheel (14) is inserted into the recess (18).

Like elements are indicated by the same reference numbers throughout the disclosure.

Figure 6:
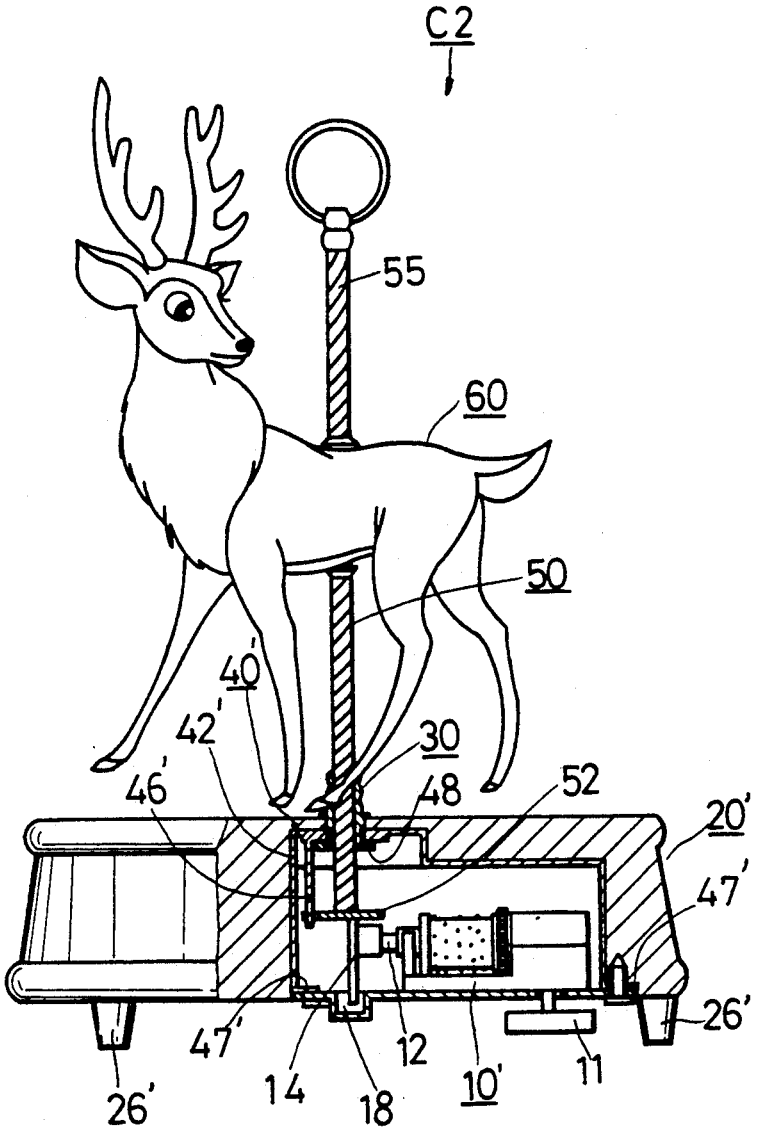
FIG. 6 is a partially sectional view of the assembled sound producing decorative article of the present invention which has another embodiment of a mounting member.

Referring to FIG. 6, another preferred embodiment of the guiding unit (40') includes a casing (42') which corresponds to the wall of the cavity (22') of the housing (20'). The casing (42') has a bottom flange (47') which is in contact with the base plate (16) and which is threaded to the bottom (20*b*) of the housing (20') when the sound producing decorative article (C2) is assembled. The guiding unit (40') has a guiding rod (46') which is formed integrally with the casing (42') and which extends downwardly from a top portion of the casing (42'). The nut (48) shown in FIG. 3 is also provided.

While the present invention has been described in connection with what is considered the most practical and preferred embodiment, it is understood that this invention is not limited to the disclosed embodiments but is intended to cover various arrangements included within the spirit and scope of the broadest interpretations and equivalent arrangements.

I claim:

1. A sound producing decorative article, comprising:

a decorative toy;

a housing having a top, a bottom, a surrounding wall connected to said top and said bottom, and a cavity being cooperatively formed thereby, said top having a first opening communicated with said cavity, said bottom having a second opening communicated with said cavity;

a tubular supporting member having a top portion, a bottom portion, an intermediate portion interconnecting said top and bottom portions, and a collar extending radially from said intermediate portion, said collar resting detachably on said top of said housing, said bottom portion passing through said first opening of said top of said housing and protruding into said cavity;

a guiding unit provided in said cavity of said housing, said guiding unit including a mounting member removably attached around said bottom portion of said tubular supporting member, and a guiding rod extending downwardly from said mounting member;

means for fastening said tubular supporting member and said mounting member of said guiding unit on said housing;

a toy supporting unit including an elongated first post that has a top end on which said decorative toy is to be detachably mounted and a bottom end, and an engaging member fixed to said first post adjacent to said bottom end, said engaging member having a notch formed thereon, said first post extending slidably through said tubular supporting member via said cavity of said housing and said notch of said engaging member slidably engaging said guiding rod when said toy supporting unit is mounted detachably on said housing; and means for moving said toy supporting unit upward and downward, said moving means including a base plate, a sound generating unit mounted on said base plate, an eccentric wheel mounted rotatably on said base plate, and a driving mechanism mounted on said base plate to rotate said eccentric wheel and said sound generating unit to produce sound, said eccentric wheel having a periphery which supports said engaging member of said toy supporting unit while said eccentric wheel, said sound generating unit and said driving mechanism are received in said cavity when said base plate is mounted detachably on said bottom of said housing in order to close said second opening of said bottom.

2. A sound producing decorative article as claimed in claim 1, wherein said mounting member of said guiding unit is a disk having a central hole.

3. A sound producing decorative article as claimed in claim 1, wherein said fastening means includes a nut screwed onto said bottom portion of said tubular supporting member so as to fasten said tubular supporting member and said mounting member of said guiding unit on said top of said housing when said collar of said tubular supporting member rests on said top of said housing and said mounting member is sleeved around said bottom portion.

4. A sound producing decorative article as claimed in claim 1, wherein said engaging member of said toy supporting unit is a plate member.

5. A sound producing decorative article as claimed in claim 1, wherein said toy supporting unit further has a second post which detachably passes through said decorative toy and which is screwed to said top end of said first post.

* * * * *